US007708177B2

(12) United States Patent
Lee

(10) Patent No.: US 7,708,177 B2
(45) Date of Patent: May 4, 2010

(54) POWDER-ACTUATED FASTENER-DRIVING TOOL

(76) Inventor: Chung-Heng Lee, 5F., No. 57, Lane 700, Jhongzheng Rd., Sindian City, Taipei County (TW) 231

( * ) Notice: Subject to any disclaimer, the term of this patent is extended or adjusted under 35 U.S.C. 154(b) by 145 days.

(21) Appl. No.: 12/137,986

(22) Filed: Jun. 12, 2008

(65) Prior Publication Data

US 2009/0159634 A1 Jun. 25, 2009

(30) Foreign Application Priority Data

Dec. 25, 2007 (TW) ..... 96149889 A

(51) Int. Cl.
*B25C 1/08* (2006.01)
*B25C 1/14* (2006.01)

(52) U.S. Cl. ..... 227/9; 227/8; 227/129; 123/46 SC; 89/1.14

(58) Field of Classification Search ..... 227/8, 227/9, 10, 139, 129, 130; 123/46 R, 46 A, 123/46 SC; 89/1.14, 27.12, 27.13, 27.14
See application file for complete search history.

(56) References Cited

U.S. PATENT DOCUMENTS 3,168,744 A * 2/1965 Kvavle ..... 227/8
3,556,379 A * 1/1971 Bayer et al. ..... 227/10
3,622,060 A * 11/1971 Gussalli ..... 227/8
3,804,315 A * 4/1974 Pomeroy ..... 227/10
4,061,261 A * 12/1977 Fredriksson et al. ..... 228/2.5
4,074,844 A * 2/1978 Hodil, Jr. ..... 227/8
4,077,556 A * 3/1978 Buchel ..... 227/8
4,349,141 A * 9/1982 Ollivier et al. ..... 227/10
4,364,506 A * 12/1982 Schneider ..... 227/10
4,741,467 A * 5/1988 Gassner et al. ..... 227/8
4,804,127 A * 2/1989 Kirkman ..... 227/10
5,048,740 A * 9/1991 Beton ..... 227/10
5,220,123 A * 6/1993 Oehry ..... 89/1.14
5,789,694 A * 8/1998 Mey ..... 86/20.15
6,761,299 B2 * 7/2004 Caringella et al. ..... 227/10

* cited by examiner

*Primary Examiner*—Paul R Durand
(74) *Attorney, Agent, or Firm*—Shook, Hardy & Bacon L.L.P.

(57) ABSTRACT

A powder-actuated fastener-driving tool includes a barrel unit inserted movably into a housing, a holder disposed movably in the housing, abutting against the barrel unit and having a through hole defined by an inner annular surface, and a spring-loaded firing pin disposed fixedly in the housing, having a free end portion extending into the through hole in the holder, and movable among normal and standby positions, where the firing pin is inclined due to engagement between the free end portion thereof and the shoulder portion of the holder, and a firing position. When a trigger unit mounted on the housing is operated to switch the firing pin from the standby position to the firing position, the free end portion of the firing pin disengages the shoulder portion of the holder to move frontwardly to thereby contact and ignite gunpowder in a chamber in a rear end portion of the barrel unit.

7 Claims, 8 Drawing Sheets

POWDER-ACTUATED FASTENER-DRIVING TOOL

CROSS-REFERENCE TO RELATED APPLICATION

This application claims priority of Taiwanese Application No. 096149889, filed on Dec. 25, 2007.

BACKGROUND OF THE INVENTION

1. Field of the Invention

The invention relates to a fastener-driving tool, more particularly to a powder-actuated fastener-driving tool.

2. Description of the Related Art

Referring to FIGS. 1 to 3, a conventional powder-actuated fastener-driving gun 1 is shown to include a housing 11, a barrel unit 12, a piston assembly 14, a sleeve 13, a holder 15, a spring-loaded firing pin 16, an L-shaped trigger plate 18, and an operating member 19.

The housing 11 has a front open end 111 and a rear end 112 opposite to each other in a direction (A).

The barrel unit 12 is inserted movably into the housing 11 via the front open end 111 of the housing 11.

The piston assembly 14 is disposed movably in the barrel unit 12. The sleeve 13 is coupled to a rear end of the barrel unit 12, and defines a chamber 131 for receiving gunpowder in the form of a load 9 therein. The holder 15 is disposed in the housing 11, abuts against the sleeve 13, and has a through hole 151.

The spring-loaded firing pin 16 is disposed in the housing 11 between the holder 15 and the rear end 112 of the housing 11, and has a thinner free end portion 161 extending into the through hole 151 in the holder 15, a thicker end portion 163 opposite to the free end portion 161 in the direction (A) and having a diameter larger than that of the free end portion 161, and an outer annular shoulder surface 162 disposed between the thinner free end portion 161 and the thicker end portion 163. The firing pin 16 is movable between a standby position, where a front tip of the thinner free end portion 161 of the firing pin 16 is spaced apart from the gunpowder in the chamber 131 in the sleeve 13, and a firing position, where the front tip of the thinner free end portion 161 of the firing pin 16 contacts and ignites the gunpowder in the chamber 131 in the sleeve 13, as shown in FIG. 3.

The trigger plate 18 is disposed in the housing 11 and adjacent to the holder 15, has a first plate portion 181 perpendicular to the direction (A) and formed with a through hole 180 permitting extension of the firing pin 16 therethrough, and a second plate portion 182 connected to one end of the first plate portion 181 and parallel to the direction (A). It is noted that, as shown in FIG. 2, the through hole 180 has a circular first hole portion 1801 having a diameter larger than that of the thicker end portion 163 of the firing pin 16, and a second hole portion 1802 having a diameter smaller than that of the thicker end portion 163 of the firing pin 16 and slightly larger than the thinner free end portion 161 of the firing pin 16. The trigger plate 18 is movable between a non-triggering position, where a part of the thinner free end portion 161 extends through the second hole portion 1802 of the through hole 180 in the first plate portion 181 and where the outer annular shoulder surface 162 abuts against an upper end of the first plate portion 181 of the trigger plate 18, as shown FIG. 1, and a triggering position, where the firing pin 16 extends through the first hole portion 1801 of the through hole 180 in the first plate portion 181 of the trigger plate 18, as shown in FIG. 3. As a result, when the trigger plate 18 is moved from the non-triggering position to the triggering position, the firing pin 16 is thus moved from the standby position to the firing position.

The operating member 19 is mounted pivotally on the housing 11, and is operable so as to drive the trigger plate 18 to move from the non-triggering position to the triggering position.

In use, prior to operation of the operating member 19, the firing pin 16 is maintained in the standby position since the outer annular shoulder surface 162 of the firing pin 16 abuts against the upper end of the first plate portion 181 of the trigger plate 18.

However, it is desired to design a power-actuated fastener-driving tool having a configuration different from that of the aforesaid conventional powder-actuated fastener-driving gun 1.

SUMMARY OF THE INVENTION

Therefore, an object of the present invention is to provide a powder-actuated fastener-driving tool with safety protection.

According to one aspect of the present invention, a powder-actuated fastener-driving tool comprises:

a housing having a front open end and a rear end opposite to each other in an axis;

a barrel unit inserted movably into the housing through the front open end and having a rear end portion that is disposed in the housing and that defines a chamber adapted for accommodating gunpowder therein;

a holder disposed movably in the housing, abutting against the rear end portion of the barrel unit, and having a through hole defined by an inner annular surface that has an inwardly extending shoulder portion; and a spring-loaded firing pin disposed in the housing and between the rear end of the housing and the holder, and having a free end portion that extends into the through hole in the holder, the firing pin being movable among a normal position, a standby position and a firing position, wherein when the firing pin is disposed in the normal position, the firing pin is inclined relative to the axis so that the free end portion of the firing pin engages the shoulder portion of the inner annular surface of the holder and is spaced apart from the gunpowder, when the firing pin is moved from the normal position to the standby position, an assembly of the barrel unit, the holder and the firing pin is moved toward the rear end of the housing, and when the firing pin is moved from the standby position to the firing position, the free end portion of the firing pin disengages the shoulder portion of the inner annular surface of the holder to move along the axis toward the rear end portion of the barrel unit to thereby contact and ignite the gunpowder in the chamber in the rear end portion of the barrel unit; and a trigger unit mounted on the housing and operable so as to enable the firing pin to switch from the standby position to the firing position.

According to another aspect of the present invention, there is provided a triggering device for a powder-actuated fastener-driving tool. The powder-actuated fastener-driving tool includes a housing having a front open end and a rear end opposite to each other in an axis, and a barrel unit inserted movably into the housing through the front open end and having a rear end portion that is disposed in the housing and that defines a chamber for accommodating gunpowder therein.

The triggering device comprises:

a holder adapted to be disposed movably in the housing, adapted to abut against the rear end portion of the barrel unit, and having a through hole defined by an inner annular surface that has an inwardly extending shoulder portion; and a spring-loaded firing pin adapted to be disposed in the housing and between the rear end of the housing and the holder, and having a free end portion that extends into the through hole in the holder, the firing pin being movable among a normal position, a standby position and a firing position, wherein when the firing pin is disposed in the normal position, the firing pin is inclined relative to the axis so that the free end portion of the firing pin engages the shoulder portion of the inner annular surface of the holder and is spaced apart from the gunpowder, when the firing pin is moved from the normal position to the standby position, an assembly of the barrel unit, the holder and the firing pin is moved toward the rear end of the housing, and when the firing pin is moved from the standby position to the firing position, the free end portion of the firing pin disengages the shoulder portion of the inner annular surface of the holder to move along the axis toward the rear end portion of the barrel unit to thereby contact and ignite the gunpowder in the chamber in the rear end portion of the barrel unit; and a trigger unit adapted to be mounted on the housing and operable so as to enable the firing pin to switch from the standby position to the firing position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
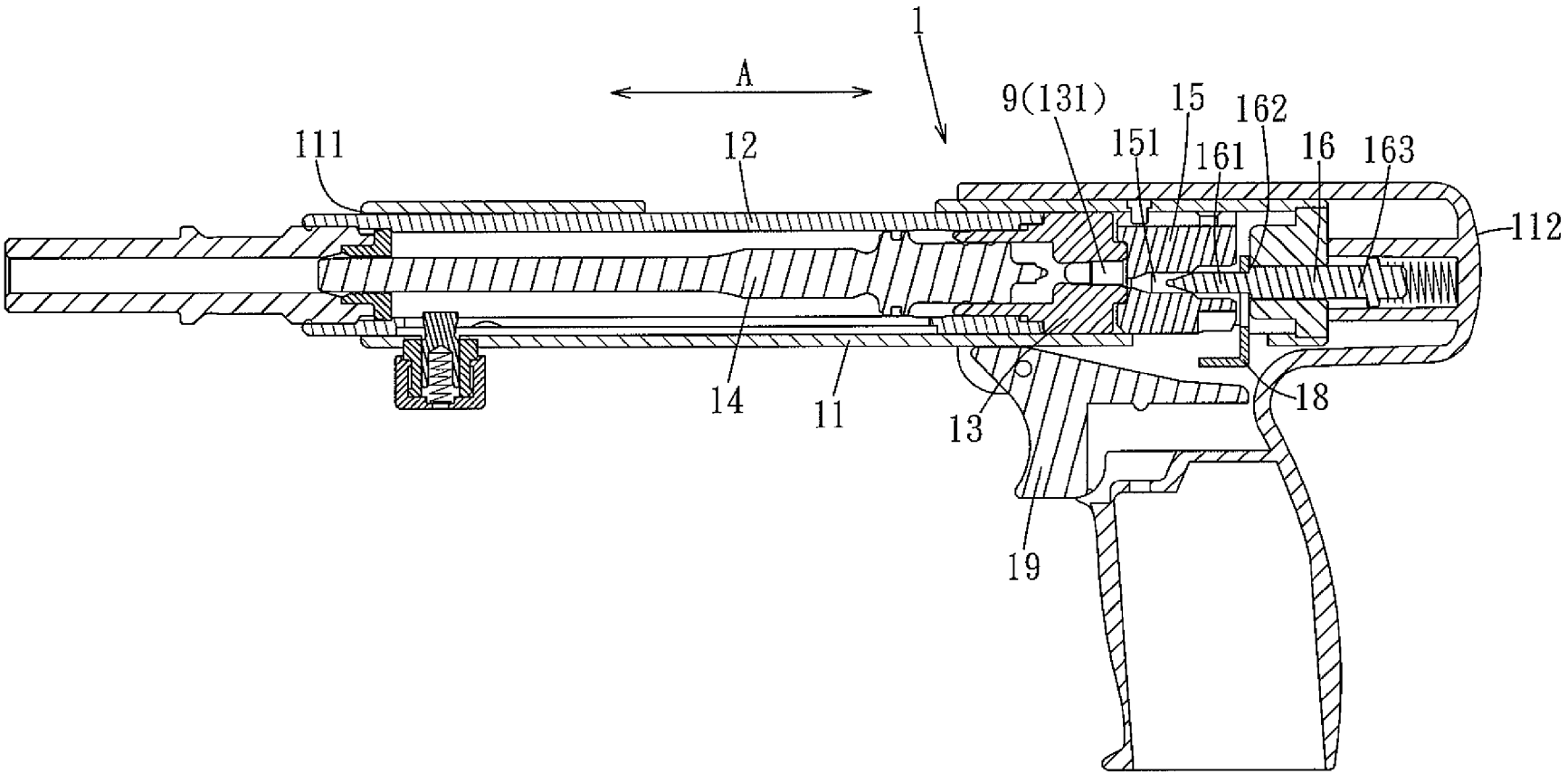
FIG. 1 PRIOR ART
FIG. 1 is a schematic sectional view showing a conventional powder-actuated fastener-driving gun when in a standby state.
Figure 2:
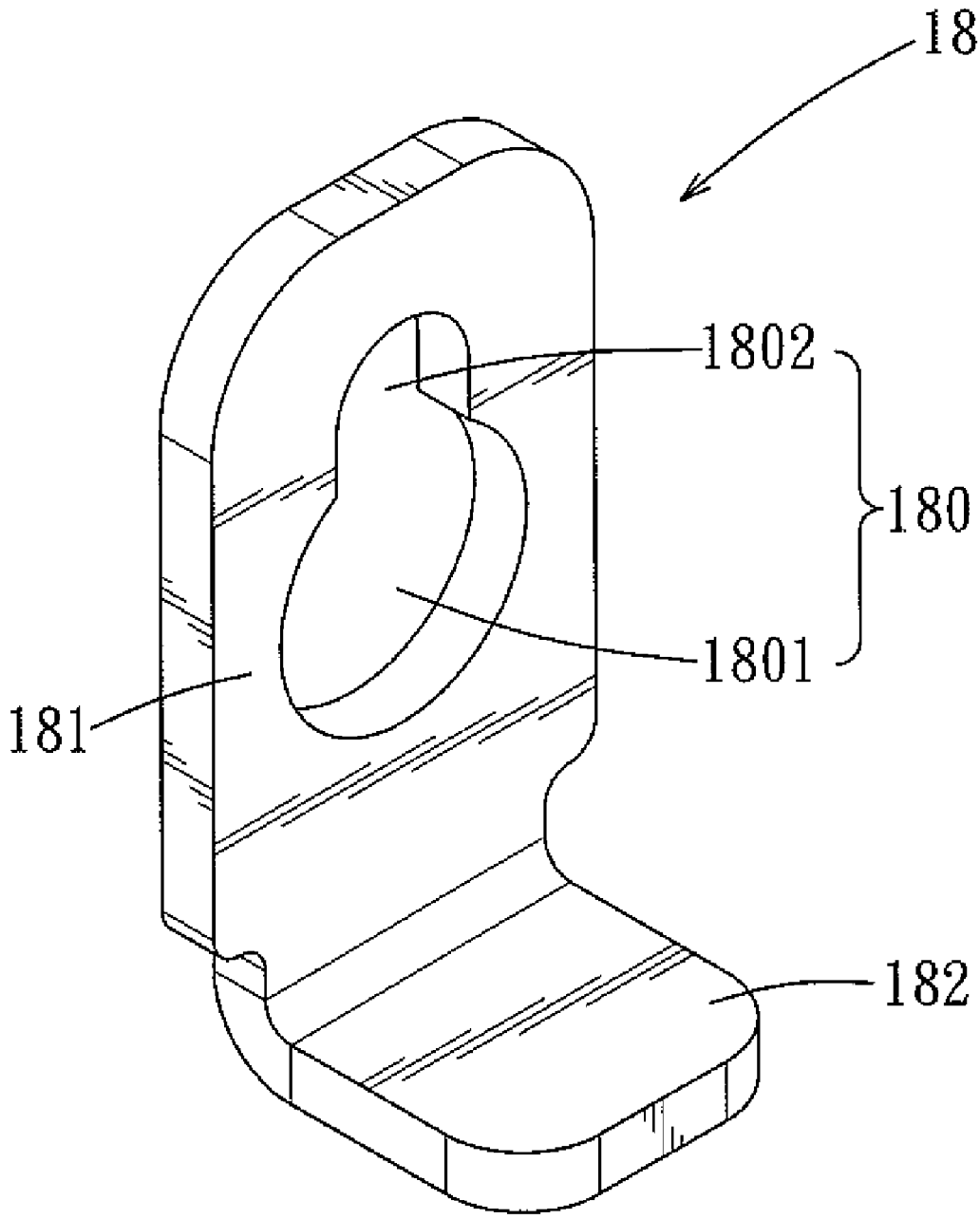
FIG. 2 PRIOR ART
FIG. 2 is a perspective view of a trigger plate of the conventional powder-actuated fastener-driving gun.
Figure 3:
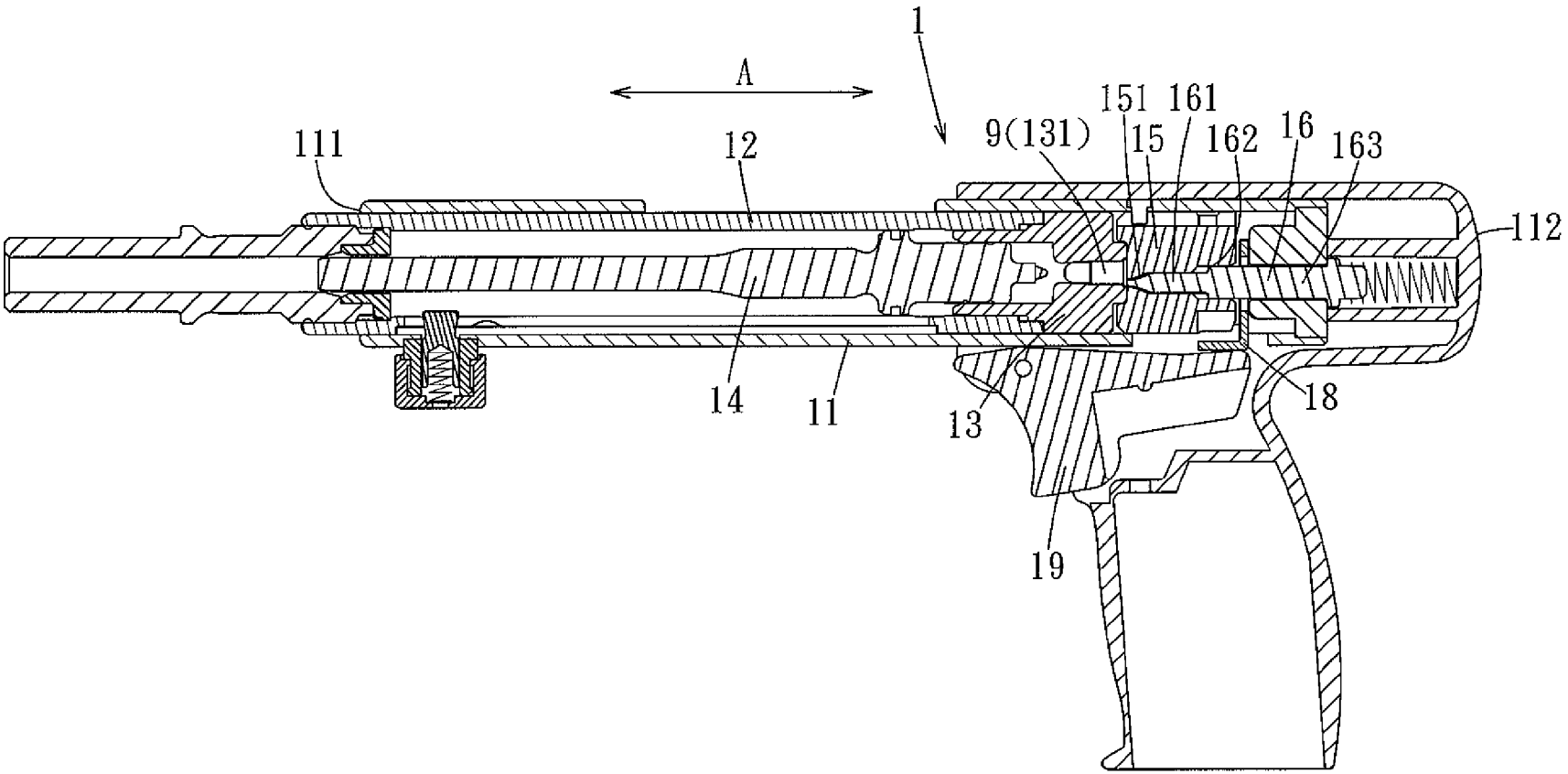
FIG. 3 PRIOR ART
FIG. 3 is a schematic sectional view showing the conventional powder-actuated fastener-driving tool when in a firing state.
Figure 4:
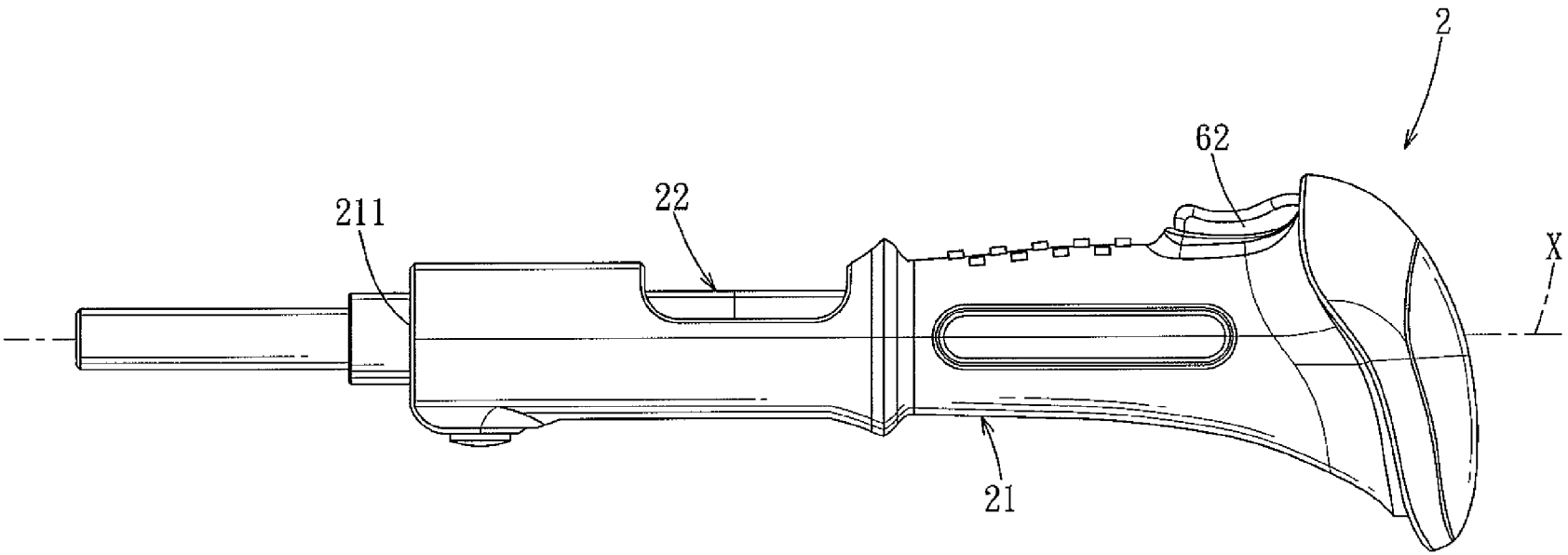
FIG. 4 is a perspective view showing the preferred embodiment of a powder-actuated fastener-driving tool.
Figure 5:
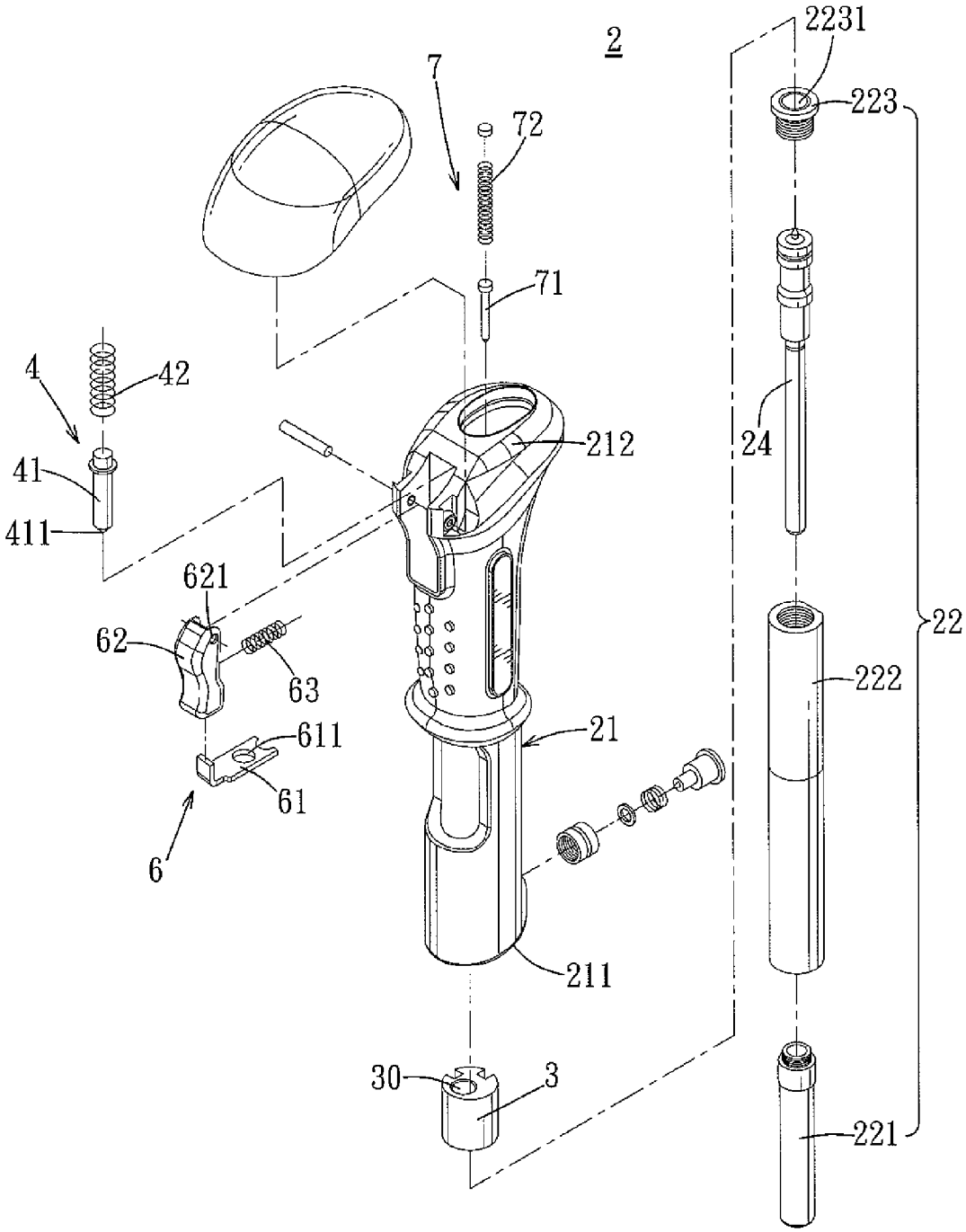
FIG. 5 is an exploded perspective view showing the preferred embodiment.
Figure 6:
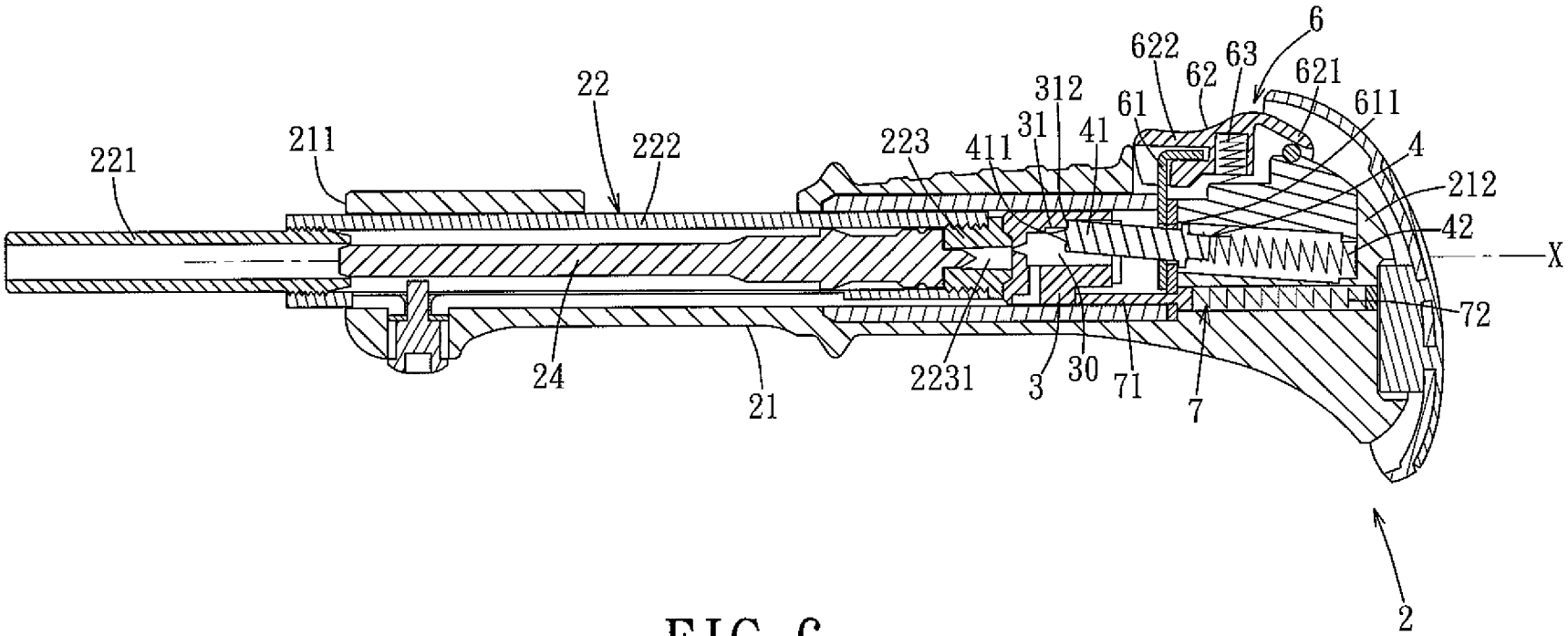
FIG. 6 is a schematic sectional view showing the preferred embodiment when in a normal state.

Referring to FIGS. 4 to 6, the preferred embodiment of a powder-actuated fastener-driving tool 2 according to the present invention is shown to include a housing 21, a barrel unit 22, a holder 3, a spring-loaded firing pin 4, a trigger unit 6, and a biasing unit 7.

The housing 21 has a front open end 211 and a rear end 212 opposite to each other in an axis (X).

The barrel unit 22 is inserted movably into the housing 21 through the front open end 211 for receiving a piston assembly 24 therein. In this embodiment, the barrel unit 22 includes a thinner first barrel 221, a thicker second barrel 222 connected threadedly to a rear end of the first barrel 221, and a sleeve 223 serving as a rear end portion of the barrel unit 22, and inserted into and connected threadedly to a rear end of the second barrel 222. The sleeve 223 defines a chamber 2231 adapted for accommodating gunpowder (not shown) therein.

The holder 3 is disposed movably in the housing 21, abuts against the sleeve 223 of the barrel unit 22, and has a through hole 30 defined by an inner annular surface 31 that has an inwardly extending shoulder portion 312.

The spring-loaded firing pin 4 is disposed in the housing 21 and between the rear end 212 of the housing 21 and the holder 3, and has a free end portion 41 extending into the through hole 30 in the holder 3 and having a front tip 411. The firing pin 4 is movable among a normal position, a standby position and a firing position. When the firing pin 4 is disposed in the normal position, the firing pin 4 is inclined relative to the axis (X) so that the free end portion 41 of the firing pin 4 engages the shoulder portion 312 of the inner annular surface 31 of the holder 3, and is spaced apart from the gunpowder in the chamber 2231 in the sleeve 223, as shown in FIG. 6.

Figure 7:
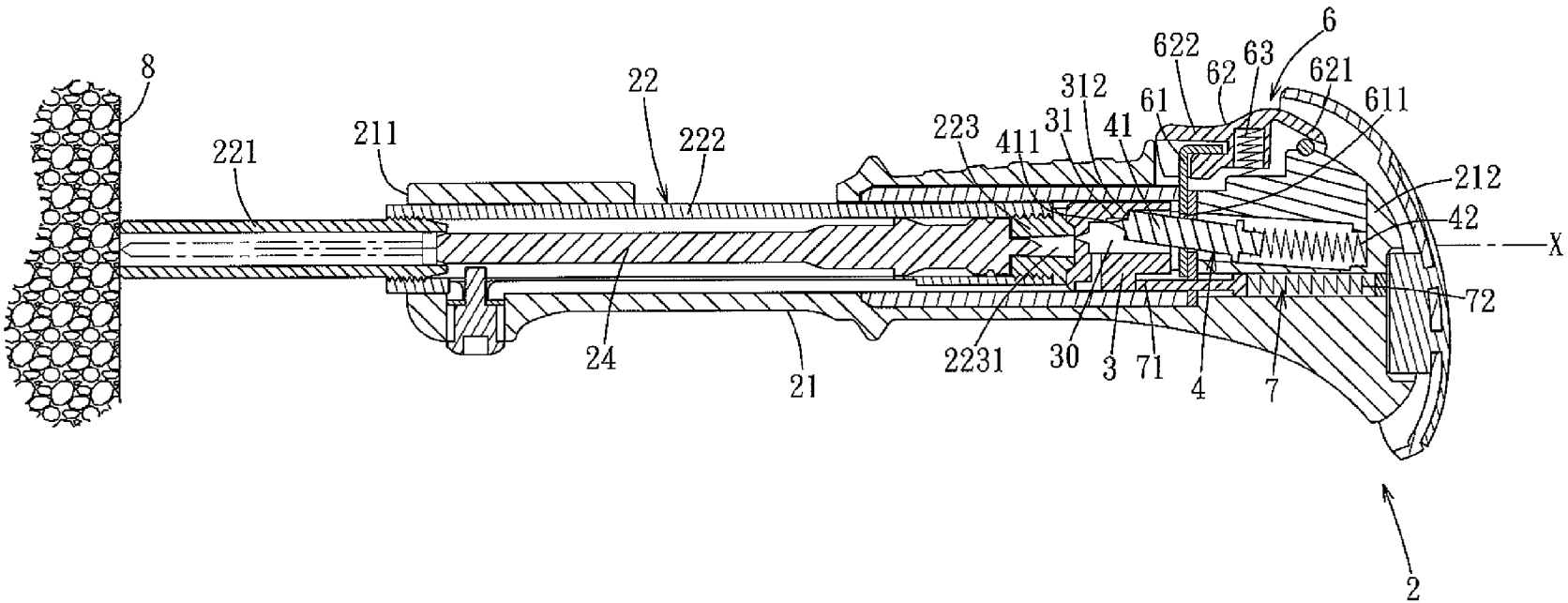
FIG. 7 is a schematic sectional view showing the preferred embodiment when in a standby state.
Figure 8:
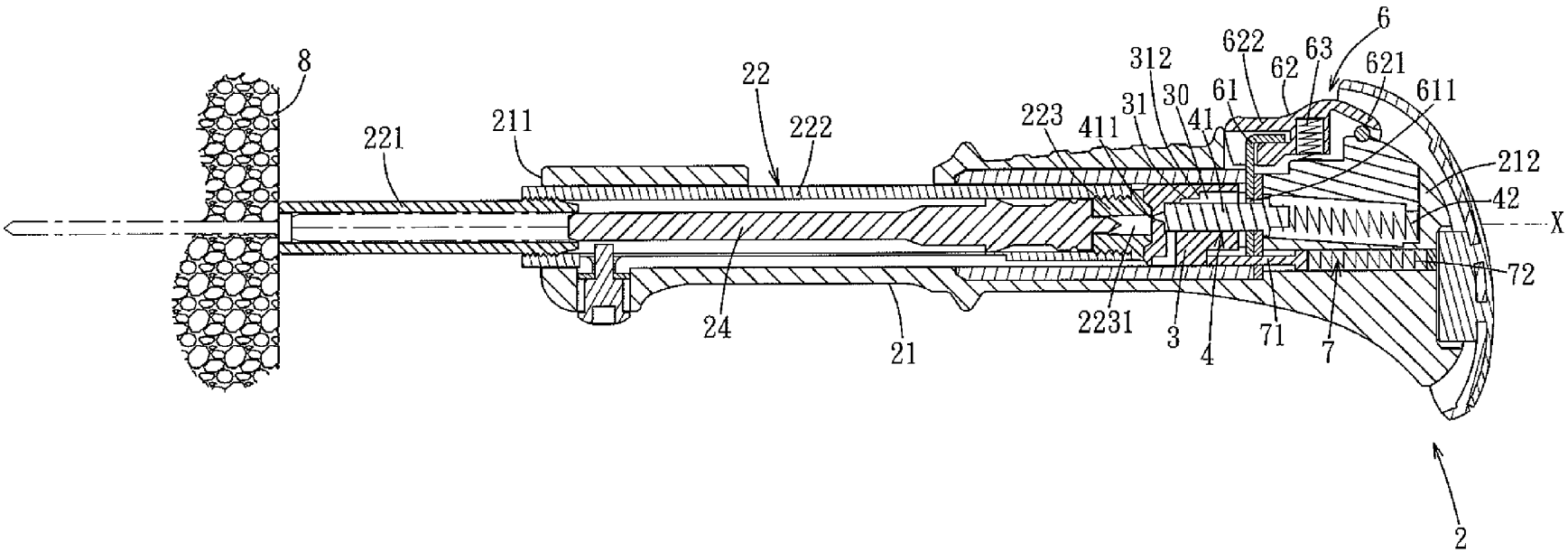
FIG. 8 is a schematic sectional view showing the preferred embodiment when in a firing state.

Referring further to FIGS. 7 and 8, when the firing pin 4 is moved from the normal position to the standby position, an assembly of the barrel unit 22, the holder 3 and the firing pin 4 is moved toward the rear end 212 of the housing 21 such that a coiled spring 42 of the firing pin 4 is compressed, as shown in FIG. 7. When the firing pin 4 is moved from the standby position to the firing position, the free end portion 41 of the firing pin 4 disengages the shoulder portion 312 of the inner annular surface 31 of the holder 3 to move along the axis (X) toward the sleeve 223 of the barrel unit 22 by virtue of the restoration force of the coiled spring 42. As a result, the front tip 411 of the free end portion 41 of the firing pin 4 contacts and ignites the gunpowder in the chamber 2231 in the sleeve 223 of the barrel unit 22, as shown in FIG. 8.

The trigger unit 6 is mounted on the housing 21, and is operable so as to enable the firing pin 4 to switch from the standby position to the firing position. In this embodiment, the trigger unit 6 includes an operating member 62, a trigger plate 61, and a biasing member 63. The operating member 62 has a pivot end 621 connected pivotally to the housing 21 by a pivot pin, and a driving end 622 opposite to the pivot end 621. The trigger plate 61 is driven by the driving end 622 of the operating member 62 to move in the housing 21, and is formed with a through hole 611 permitting extension of the firing pin 4 therethrough. It is noted that the through hole 611 has a diameter slightly greater than that of the firing pin 4. The operating member 62 is operable so as to enable the trigger plate 61 to move between a triggering position and a non-triggering position. As shown in FIGS. 6 and 7, when the trigger plate 61 is disposed at the non-triggering position, the firing pin 4 is held by the trigger plate 61 to maintain engagement between the free end portion 41 of the firing pin 4 and the shoulder portion 312 of the inner annular surface 31 of the holder 3. When the trigger plate 61 is moved from the non-triggering position to the triggering position by virtue of movement of the driving end 622 of the operating member 62 toward the housing 21, the free end portion 41 of the firing pin 4 is pushed by the trigger plate 61 to disengage the shoulder portion 312 of the inner annular surface 31 of the holder 3 so that the firing pin 4 is moved from the standby position to the firing position. The biasing member 63, such as a coiled spring, is disposed between the operating member 62 and the housing 21 for biasing the trigger plate 61 to the non-triggering position.

The biasing unit 7 is disposed in the housing 21 for biasing an assembly of the holder 3 and the barrel unit 22 to move along the axis (X) toward the front open end 211 of the housing 21. In this embodiment, the biasing unit 7 includes a pushing member 71 abutting against a rear end of the holder 3, and a coiled spring 72 disposed between the pushing member 71 and the rear end 212 of the housing 21.

In use, after a fastener, for example a nail as indicated by imaginary lines in FIG. 7, is disposed in the first barrel 221 of the barrel unit 22, the first barrel 221 of the barrel unit 22 abuts against an article 8 to be fastened while the housing 21 is pushed forcedly toward the article 8 so that the assembly of the barrel unit 22, the holder 3 and the firing pin 4 is moved toward the rear end 212 of the housing 21. As a result, the firing pin 4 is moved from the normal position to the standby position. Subsequently, the trigger plate 61 is moved from the non-triggering position to the triggering position by pressing the driving end 622 of the operating member 62 so that the firing pin 4 is moved from the standby position to the firing position. Thus, the gunpowder in the chamber 2231 is ignited by the front tip 411 of the firing pin 4 to generate kinetic energy for driving the fastener to move into the article 8 by the piston assembly 24.

Thereafter, while the first barrel 221 of the barrel unit 22 is removed from the article 8, an assembly of the barrel unit 22 and the holder 3 is pushed by the pushing member 71 of the biasing unit 7 to move frontwardly as a result of a restoration force of the coiled spring 72, and the trigger plate 61 is moved from the trigger position to the non-triggering position as a result of a restoration force of the biasing member 63 such that the free end portion 41 of the firing pin 4 engages the shoulder portion 312 of the inner annular surface 31 of the holder 3 and that the firing pin 4 is inclined relative to the axis (X) again, i.e., the firing pin 4 is moved from the firing position to the normal position.

It is noted that, during use, the firing pin 4 cannot remain in the standby position unless the housing 21 is continuously pushed toward the article 8 prior to operation of the trigger unit 6. In other words, once pushing of the housing 21 toward the article 8 is terminated, the firing pin 4 is immediately moved from the standby position back to the normal position. On the other hand, when the firing pin 4 is disposed in the normal position, the gunpowder in the chamber 2231 cannot be ignited even if the trigger plate 61 is moved from the non-triggering position to the triggering position. Therefore, the powder-actuated fastener-driving tool 2 of the present invention can effectively prevent unintentional ignition of the gunpowder, thereby ensuring safety during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A powder-actuated fastener-driving tool comprising:

a housing having a front open end and a rear end opposite to each other in an axis;

a barrel unit inserted movably into said housing through said front open end and having a rear end portion that is disposed in said housing and that defines a chamber adapted for accommodating gunpowder therein;

a holder disposed movably in said housing, abutting against said rear end portion of said barrel unit, and having a through hole defined by an inner annular surface that has an inwardly extending shoulder portion; and a spring-loaded firing pin disposed in said housing and between said rear end of said housing and said holder, and having a free end portion that extends into said through hole in said holder, said firing pin being movable among a normal position, a standby position and a firing position, wherein when said firing pin is disposed in the normal position, said firing pin is inclined relative to the axis so that said free end portion of said firing pin engages said shoulder portion of said inner annular surface of said holder and is spaced apart from the gunpowder, when said firing pin is moved from the normal position to the standby position, an assembly of said barrel unit, said holder and said firing pin is moved toward said rear end of said housing, and when said firing pin is moved from the standby position to the firing position, said free end portion of said firing pin disengages said shoulder portion of said inner annular surface of said holder to move along the axis toward said rear end portion of said barrel unit to thereby contact and ignite the gunpowder in said chamber in said rear end portion of said barrel unit; and a trigger unit mounted on said housing and operable so as to enable said firing pin to switch from the standby position to the firing position.

2. The powder-actuated fastener-driving tool as claimed in claim 1, wherein:

said trigger unit includes an operating member having a pivot end connected pivotally to said housing, and a driving end opposite to said pivot end, and a trigger plate driven by said driving end of said operating member to move in said housing and formed with a through hole permitting extension of said firing pin therethrough, said through hole having a diameter slightly greater than that of said firing pin;

said operating member is operable so as to enable said trigger plate to move between a triggering position and a non-triggering position;

when said trigger plate is disposed at the non-triggering position, said firing pin is held by said trigger plate to maintain engagement between said free end portion of said firing pin and said shoulder portion of said inner annular surface of said holder; and when said trigger plate is moved from the non-triggering position to the triggering position, said free end portion of said firing pin is pushed by said trigger plate to disengage said shoulder portion of said inner annular surface of said holder so that said firing pin is moved from the standby position to the firing position.

3. The powder-actuated fastener-driving tool as claimed in claim 2, wherein said trigger unit further includes a biasing member for biasing said trigger plate to the non-triggering position.

4. The powder-actuated fastener-driving tool as claimed in claim 1, wherein said free end portion of said firing pin has a front tip adapted to contact the gunpowder in said chamber in said rear end portion of said barrel unit when said firing pin is disposed in the firing position.

5. The powder-actuated fastener-driving tool as claimed in claim 1, further comprising a biasing unit disposed in said housing for biasing an assembly of said holder and said barrel unit to move along the axis toward said front open end of said housing.

6. The powder-actuated fastener-driving tool as claimed in claim 5, wherein said biasing unit includes a pushing member abutting against a rear end of said holder, and a coiled spring disposed between said pushing member and said rear end of said housing.

7. A triggering device for a powder-actuated fastener-driving tool that includes a housing having a front open end and a rear end opposite to each other in an axis, and a barrel unit inserted movably into the housing through the front open end and having a rear end portion that is disposed in the housing and that defines a chamber for accommodating gunpowder therein, said triggering device comprising:

a holder adapted to be disposed movably in the housing, adapted to abut against the rear end portion of the barrel unit, and having a through hole defined by an inner annular surface that has an inwardly extending shoulder portion; and a spring-loaded firing pin adapted to be disposed in the housing and between the rear end of the housing and said holder, and having a free end portion that extends into said through hole in said holder, said firing pin being movable among a normal position, a standby position and a firing position, wherein when said firing pin is disposed in the normal position, said firing pin is inclined relative to the axis so that said free end portion of said firing pin engages said shoulder portion of said inner annular surface of said holder and is spaced apart from the gunpowder, when said firing pin is moved from the normal position to the standby position, an assembly of the barrel unit, said holder and said firing pin is moved toward the rear end of said housing, and when said firing pin is moved from the standby position to the firing position, said free end portion of said firing pin disengages said shoulder portion of said inner annular surface of said holder to move along the axis toward the rear end portion of the barrel unit to thereby contact and ignite the gunpowder in the chamber in the rear end portion of the barrel unit; and a trigger unit adapted to be mounted on the housing and operable so as to enable said firing pin to switch from the standby position to the firing position.

* * * * *